United States Patent [19]

Sandhaus

[11] 4,413,742

[45] Nov. 8, 1983

[54] CHILD-RESISTANT CLOSURE MEMBER

[76] Inventor: Jeffrey Sandhaus, Rte. 9W, Snedens Landing, Palisades, N.Y. 10964

[21] Appl. No.: 335,216

[22] Filed: Dec. 28, 1981

[51] Int. Cl.[3] ..... B65D 55/02

[52] U.S. Cl. ..... 215/216; 215/301

[58] Field of Search ..... 215/216, 221, 301; 222/153; 220/315

[56] References Cited

U.S. PATENT DOCUMENTS

| | | | |
|---|---|---|---|
| 3,182,840 | 5/1965 | Polzin | 215/216 |
| 3,365,088 | 1/1968 | Turner | 215/221 |
| 3,514,003 | 5/1970 | Fitzgerald | 215/221 |
| 3,739,934 | 6/1973 | Bruno | 215/216 |
| 3,776,406 | 12/1973 | Milbourne, Sr. | 215/216 |
| 4,106,651 | 8/1978 | Lemons | 215/221 |
| 4,187,953 | 2/1980 | Turner | 215/301 |

*Primary Examiner*—George T. Hall
*Attorney, Agent, or Firm*—Steinberg & Raskin

[57] ABSTRACT

A child-resistant closure member adapted to be threadedly fastened onto the neck of a container is formed of a deformable material and has a top and an integral peripheral skirt on the inwardly facing surface of which screw threads are formed to allow the closure member to be rotatably screwed onto the container neck. A locking member having a locking portion is integrally formed with the closure member so as to be movable between a first position wherein the locking portion extends into the interior space defined by the skirt and a second position wherein the locking portion is withdrawn from the interior space. In a preferred embodiment, the locking member is constituted by a segment of the peripheral skirt itself and a radial segment of the closure top which is integral with and forms a continuation of the peripheral skirt segment. The locking portion extends into a slot formed in the neck of the container when the locking member is in the first position to prevent rotation of the closure member with respect to the neck of the container.

13 Claims, 11 Drawing Figures

CHILD-RESISTANT CLOSURE MEMBER

BACKGROUND OF THE INVENTION

Many different types of so-called child resistant or safety closure members are known which are intended to close the open ends of containers in a manner so as to render it difficult for a child to remove the closure member to obtain access to the contents of the container. As examples of known closure members of this type, reference is made to U.S. Pat. Nos. 3,860,137 and 3,964,634.

Known safety closure members generally fall into one of several categories. One category is constituted by closure members which include locking protuberances or the like which cooperate with locking recesses or grooves formed on the neck of the container. Some of these closure members are characterized in that in order to remove them from the container, it is necessary to rotate the closure member relative to the container neck until the locking protuberance and associated recess in which it is received are no longer engaged thereby permitting the closure member to be removed from the container. Another category of child-resistant closure member is constituted by closure members characterized by a top and a depending peripheral threaded skirt and which are adapted to be threadedly fastened onto the neck of the container. In one well known closure member of this type, a threaded cylindrical insert is provided within the closure member which will not rotate with rotation of the closure member unless a substantial axial force is exerted on the top of the closure member simultaneously with the rotation thereof.

Problems have been encountered with various ones of the presently known closure members. Generally, existing child-resistant closure members are often designed in a manner such that not only is a child prevented from obtaining access to the contents of the container but it is not uncommon for adults to encounter difficulties in removing the closure members from the container. For example, elderly or debilitated people often have trouble in accurately rotating the closure member with respect to the container neck to disengage the locking protuberance and recess in the case of the first category of closure members discussed above. In the case of the second category of closure members identified above, it is not uncommon for even a healthy person to have difficulty in rotating the threaded insert situated within the closure member to obtain access to the contents of the container. This may be due to the inability of the person to exert sufficient force to rotate the threaded insert along with the closure member or may be the result of a failure of the closure member itself. Moreover, certain conventional child-resistant closure members are subject to being inadvertently opened and are generally relatively complicated in construction and expensive in manufacture.

SUMMARY OF THE INVENTION

Accordingly, one object of the present invention is to provide a new and improved child-resistant closure member of the type having a top and an integral peripheral skirt and which is adapted to be threadedly fastened onto the neck of a container.

Another object of the present invention is to provide a new and improved child-resistant closure member of the threaded type which will permit access to the contents of a container through the performance of two distinct but easily performed maneuvers.

Still another object of the present invention is to provide a new and improved child-resistant closure member of the threaded type which can be opened by elderly or debilitated persons in a relatively easy manner yet which will reliably prevent access to the container contents by infants or young childern.

Briefly, in accordance with the present invention, these and other objects are attained by providing an improvement in a unitary closure member which is adapted to be threadedly fastened onto the neck of a container and which is forme of a deformable material so as to have a top and an integral depending peripheral skirt. More particularly, according to the present invention, the closure member skirt has screw threads formed on the inwardly facing surface thereof which are adapted to threadedly cooperate with screw threads formed on the outer surface of the neck of the container to allow the closure member to be rotatably screwed onto the container neck. A locking member having a locking portion is integrally formed with the closure member in a manner so as to be movable between a first position wherein the locking portion extends into the interior space defined by the skirt inwardly of the screw threads and a second position wherein the locking portion is withdrawn from the interior space.

The locking member is constituted at least in part by a segment of the peripheral skirt itself. The locking portion of the locking member is constituted by a protuberance which extends inwardly from the skirt segment, the latter being at least partially separated from the skirt so as to be movable relative thereto between the first position wherein the protuberance extends into the interior space and the second position wherein the protuberance is withdrawn from the interior space.

The closure member is intended for use with a container having a neck with screw threads formed on the outwardly facing surface thereof which cooperate with the internal screw threads of the closure member. A slot or recess is formed in the neck of the container which receives the locking portion of the locking member of the closure member after the closure member has been threadedly fastened onto the container neck and the locking member moved to its first position. In this manner, the closure member is prevented from rotating on the container neck. In order to unscrew the closure member from the container neck the locking member is moved to its second position wherein the locking portion of the locking member is withdrawn from the slot or recess formed in the container neck thereby permitting the closure member to be unscrewed from the neck of the container.

Thus, two distinct but easily performed maneuvers are necessary in order to gain access to the contents of the container. The closure member is easily removed by the elderly or debilitated yet will prevent access to the container contents by infants or children.

In one embodiment, the locking member is further constituted by a radial segment of the closure member top with the locking member being integrally connected to the closure member only at the top thereof. In this embodiment, the closure member top has a central dome-shaped portion which defines an inwardly facing cam surface at its periphery which is adapted to abut the upper edge surface of the container neck when the closure member is threadedly fastened onto the neck of the container. When the dome-shape portion of the closure member top is depressed, the locking member will pivotally move from the first to the second position thereby allowing the closure member to be unscrewed from the neck of the container.

In another embodiment, the locking member constituted by the integral peripheral skirt and radial top segments is connected to the closure member only on the skirt thereof and movement of the locking member from the first to the second position is accomplished by moving the radial top segment outwardly.

A detent portion is preferably formed on at least one of the side surfaces of the locking portion so as to extend laterally therefrom adjacent to the inwardly facing surface of the skirt when the locking member is in the first position. In this manner, the locking member is releasably hedl in its first position. A recess is preferably formed in a side surface of the skirt which is adapted to receive the lateral detent portion of the locking member when the latter is moved to its second position so as to releasably hold the locking member in that second position.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DETAILED DESCRIPTION OF THE PREFERRED EMBODIMENTS

Figure 1:
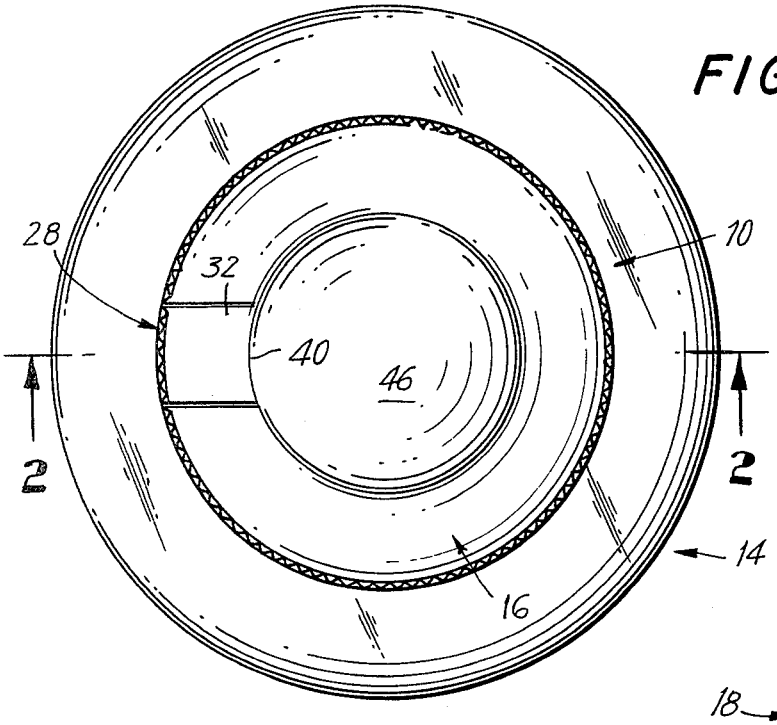
FIG. 1 is a top plan view of one embodiment of a closure member in accordance with the present invention in association with a container.

Referring now to the drawings wherein like reference characters designate identical or corresponding parts throughout the several views, and more particularly to FIGS. 1-6, a first embodiment of a closure member in accordance with the present invention is generally designated 10. Closure member 10 is illustrated as being threadedly fastened onto the neck 12 of a container 14. Although the container 14 may house contents of any type, the present invention has particular applicability to closing containers which house medicine or the like.

Closure member 10 is formed of a deformable material such, for example, as a resilient polymer composition. For example, a polyolefin such as polyethylene may be utilized.

Closure member 10 is a unitary member and has a top 16 and an integral skirt 18 downwardly depending from the periphery of the top 16.

The closure member skirt 18 has screw threads 20 formed on the inwardly facing surface 22 thereof which are adapted to threadedly cooperate with screw threads 24 formed on the outer surface 26 of the container neck 12. The outer surface of the peripheral skirt 18 may be fluted or knurled in order to facilitate rotation thereof as is common.

According to the present invention, a locking member 28 is integrally formed with the closure member 10. The locking member 28 is constituted by a segment 30 of the peripheral skirt 18 itself of closure member 10. Thus, the peripheral skirt segment 30 comprises a segment of the skirt which has been separated from the skirt itself so as to be movable with respect thereto.

Moreover, the locking member 28 is further constituted by a radial segment 32 of the top 16 of closure member 10. Thus, the radial closure top segment 32 is integral with and forms a continuation of the peripheral skirt segment 30 and is at least partially separated from the major portion of the closure member top 16 so as to be movable with respect thereto.

Figure 2:
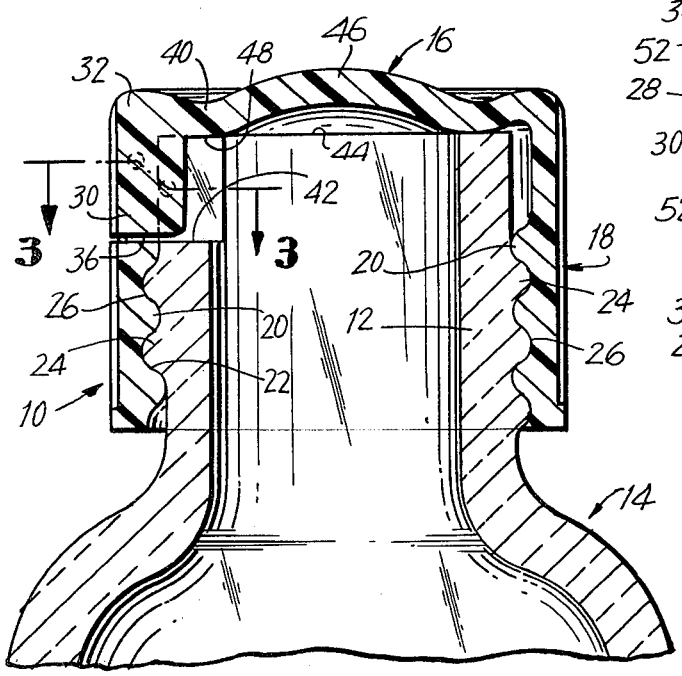
FIG. 2 is a section view taken along line 2—2 of FIG. 1.
Figure 3:
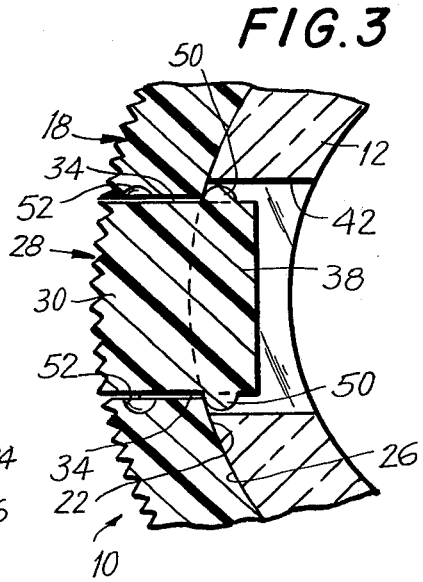
FIG. 3 is a section view taken along line 3—3 of FIG. 2.
Figure 4:
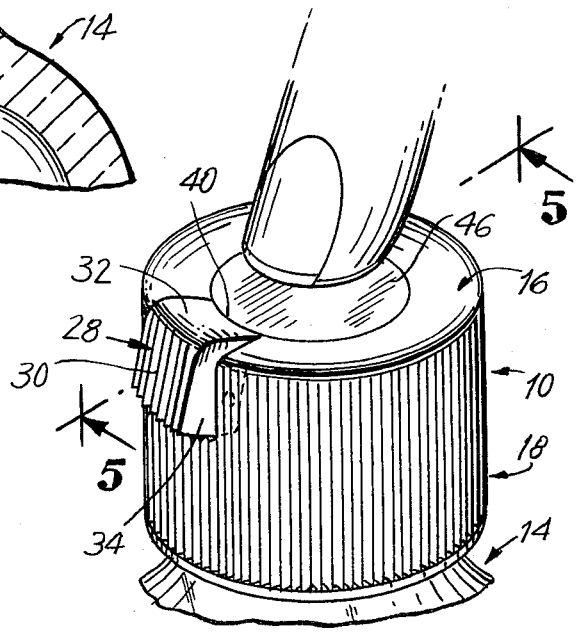
FIG. 4 is a perspective view of the embodiment of the invention illustrated in FIGS. 1-3 illustrating the operation of the present invention.

In the embodiment of the invention illustrated in FIGS. 1-6, the locking member 28 is integrally connected to the closure member 10 only at the top 16 thereof as best seen in FIG. 4. More particularly, the locking member 28 is formed having a pair of side surfaces 34 and a lower or bottom surface 36 extending between the side surfaces 34 formed within the skirt 18. It is therefore seen that the locking member 28 can be thought of as constituting a "cutout" from the closure member 10 with the side and bottom surfaces 34 and 36 being formed by cutting or slitting the closure member itself at the locations illustrated in the drawings.

The locking member 28 is formed with a locking portion 38 which extends inwardly towards the interior space defined by the peripheral skirt 18. In the illustrated embodiment, the locking portion 38 is formed by enlarging the thickness of the portion of the skirt 18 which constitutes the skirt segment 30 of locking member 28. This thickness is enlarged sufficiently such that the locking portion 38 when in a first position illustrated in FIGS. 2 and 3 extends into the interior space defined by skirt 18 inwardly of the closure member screw threads 20, i.e., inwardly beyond the inwardly facing surface 22 of skirt 18.

As noted above, the locking member 28 is connected to the closure member 10 at the top 16 thereof. More particularly, the radially innermost region of the top segment 32 merges with the major portion of top 16 at a connecting region 40 which acts as a so-called "living hinge". Thus, the locking member 28 is pivotally movable from its first position illustrated in FIGS. 1-3 wherein the locking portion 38 extends into the interior space defined by the skirt inwardly of the screw threads 20 to a second position illustrated in FIGS. 4-6 wherein the locking portion 38 is withdrawn from the interior space.

The threaded neck 12 of container 14 is formed with a slot or recess 42 preferably communicating with the upper edge 44 thereof. The slot 42 is formed at an appropriate location such that when the closure member 10 is threadedly fastened onto the neck 12 of container 14 so that the top 16 of the closure member closes the open end of the container, the locking portion 38 of locking member 28 is in or can be brought into alignment with slot 42. It is therefore seen that when the closure member 10 has been threadedly fastened onto the neck 12 of container 14, the locking member 28 can be moved into its first position (FIGS. 1–3) wherein the locking portion 38 thereof is received within the slot 42. In this manner, the closure member 10 will be prevented from being rotated relative to the container neck by virtue of the locking portion 38 being received within slot 42. When it is desired to unscrew the closure member 10 from the container neck 12, the locking member 28 is moved to its second position (FIGS. 4–6) whereupon the locking portion 38 is withdrawn from the slot 42 thereby permitting the closure member to be rotated with respect to the container neck 12 to unscrew the former from the latter. Of course, when the closure member 10 is being rotatably screwed onto the container neck 12, the locking member 28 is in its second position with the locking portion 38 being withdrawn from the interior space defined inwardly of the peripheral skirt 18.

Figure 5:
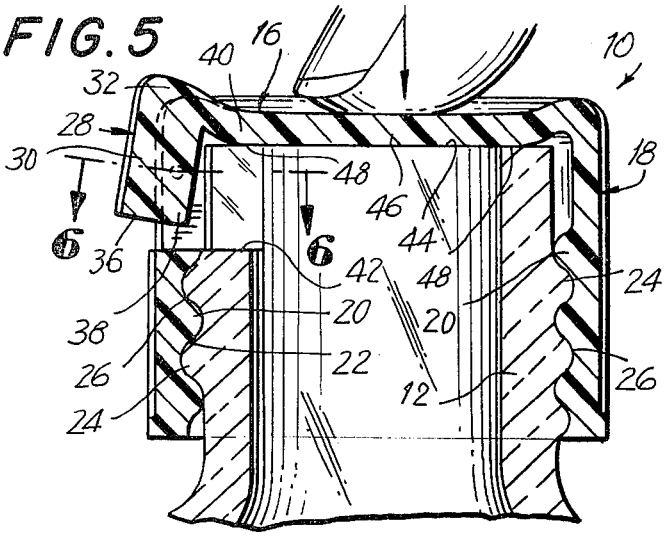
FIG. 5 is a section view taken along line 5—5 of FIG. 4.
Figure 6:
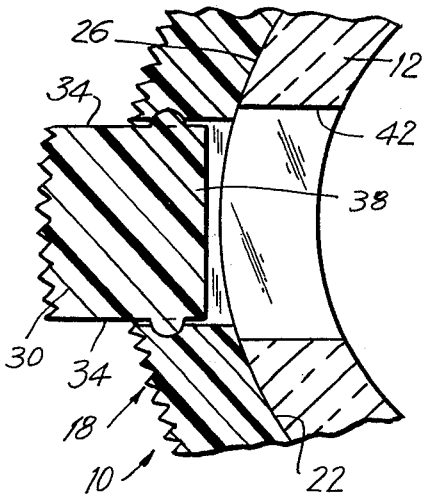
FIG. 6 is a section view taken along line 6—6 of FIG. 5.

Still referring to the embodiment of the invention illustrated in FIGS. 1–6, the closure member top 16 has a central dome-shaped portion 46 which defines at its outermost region an inwardly facing cam surface 48. Cam surface 48 is located so as to abut the upper edge 44 of the container neck 12 when the closure member 10 has been threadedly fastened onto the container neck as best seen in FIGS. 2 and 5. The connecting region 40 where the locking member 28 is connected to the closure member 10 is situated proximate to a portion of the cam surface 48. By depressing the central dome-shaped portion of top 16 as seen in FIGS. 4 and 5, a camming action is obtained against the upper edge 44 of neck 12 and the locking member 28 is pivotally moved from its first or locking position to its second or unlocking position. Thus, the dome-shaped configuration of the top 16 of closure member 10 functions as a means for moving the locking member between the first and second positions.

The locking portion 38 of locking member 28 is at least partially defined by side surfaces which in the illustrated embodiment constitute continuations of the side surfaces 34 of locking member 28. A detent portion constituted by a protuberance 50 extends laterally from each of the side surfaces 34 so as to be located adjacent to the inwardly facing surface 22 of skirt 18 when the locking member 28 is in its first position as seen in FIG. 3. The detent protuberances 50 thereby serve to releasably hold the locking member 28 in its first or locking position. However, the detent protuberances 50 are formed of deformable material so that when sufficient force is exerted on the dome-shape central portion 46 of top 16, the locking member 28 will be pivotally moved towards its second position, i.e., the detent protuberances 50 will be deformed so as to allow outward movement of locking member 28. A pair of recesses 52 are formed in the side surfaces of skirt 18 which extend outwardly from the inwardly facing surface 22 thereof contiguous with the locking member 28 at a position such that the recesses 52 will receive the laterally extending detent protuberances 50 when the locking member 28 has moved to its second position, i.e., after the locking portion 38 has been withdrawn from the interior space defined within skirt 18. In this manner, the locking member 28 will be releasably held in its second position. After the closure member 10 with the locking member 28 in its second position has been rotatably screwed onto the neck 12 of container 14, it is only necessary to apply an inwardly radial force to the locking member 28 to release the detent protuberances 50 from within the recesses 52 and thereby move the locking member 28 back to the first position whereupon the locking portion 38 is received within the slot 42 to lock the closure member 10 onto the neck of the bottle 14.

Referring now to FIGS. 7–11, a second embodiment of a closure member in accordance with the present invention is illustrated. The various elements of the second embodiment of the closure member which correspond to analogous elements discussed above in connection with the first embodiment will be designated by the same reference numeral, primed. The closure member 10' is illustrated in use with the same container 14 described in connection with the previously discussed embodiment.

The closure member 10' illustrated in FIGS. 7–11 corresponds to the previously discussed embodiment in that the same is formed of a deformable material and includes a top 16' and a downwardly depending peripheral skirt 18'. Screw threads 20' are formed on the inwardly facing surface 22' of skirt 18' so that closure member 10' can be threadedly fastened to the threaded neck 12 of container 14.

Closure member 10' is formed with an integral locking member 28' which is constituted by a segment 30' of skirt 18' and an integral radial segment 32' of top 16', the top segment 32' forming an integral continuation of the peripheral skirt segment 30'.

The embodiment illustrated in FIGS. 7–11 differs from that illustrated in FIGS. 1–6 in that the locking member 28' constituted by the integral peripheral skirt and radial top segments 30' and 32' is integrally connected to the closure member 10' only on the skirt 18' thereof. Thus, it is seen that the radial top segment 32' is completely separated from the closure member top 16' while the peripheral skirt segment 30' integrally merges with the skirt 18' at a lower connecting region 54 which functions as a socalled "living hinge".

Figure 7:
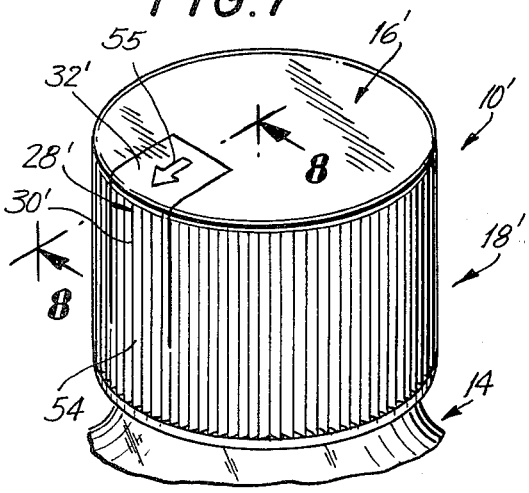
FIG. 7 is a perspective view illustrating another embodiment of a closure member in accordance with the present invention.
Figure 10:
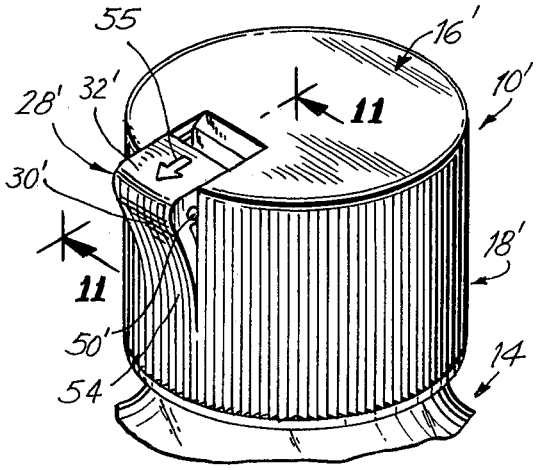
FIG. 10 is a perspective view illustrating the operation of the embodiment of the invention illustrated in FIGS. 6-9.
Figure 8:
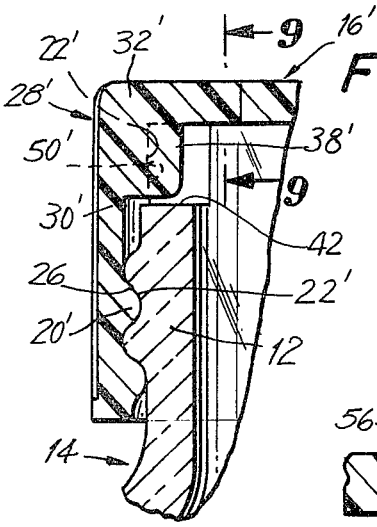
FIG. 8 is a section view taken along line 8—8 of FIG. 7.
Figure 9:
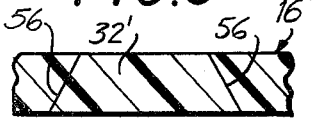
FIG. 9 is a section view taken along line 9—9 of FIG. 8.
Figure 11:
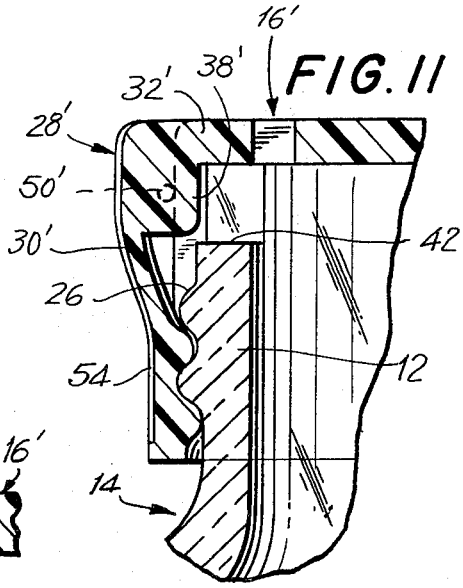
FIG. 11 is a section view taken along line 11—11 of FIG. 10.

In order to move the locking member 28' from its first position illustrated in FIGS. 7 and 8 wherein the locking portion 38' extends into the slot 42 of the container neck 12 to its second position illustrated in FIGS. 10 and 11 wherein the locking portion 38' is withdrawn from the slot 42, the radial top segment 32' is merely moved radially outwardly in the direction of the arrow 55 illustrated in FIGS. 7 and 10. In order to retain the top segment 32' in the same plane as the top 16' of closure member 10', the side surfaces 56 (FIG. 9) of top segment 32 extend downwardly and outwardly while the contiguous side surfaces of top 16' are similarly configured thereby creating a dovetail arrangement which restrains the movement of the closure top segment 32' with respect to the top except in the radial direction.

A detent protuberance 50' extends laterally from the side surface of locking portion 38' so as to removably retain the locking member 28' in the first position by engaging the inwardly facing surface 22' when locking member 28' is in the first position as seen in FIG. 8. Similarly, detent protuberances 50' releasably hold the locking member 28' in the second or unlocked position by engaging the outwardly facing surface of skirt 18' when the locking member is in its second or unlocked position as best seen in FIGS. 10 and 11.

It will be appreciated that with respect to either of the illustrated embodiments of the invention, a child-resistant closure member is provided which permits access to the contents of the container in two distinct but easily performed maneuvers, namely the movement of the locking member from its first or locked position to its second or unlocked position and subsequent rotation of the enclosure member to unscrew the same from the neck of the container. This operation is relatively simple and can be easily accomplished by the elderely or debilitated yet is sufficiently complicated to prevent access to the contents of the container by infants or young children. By varying the sizes of the detent protuberances, the pressure necessary to move the locking member from the first to the second position can be suitably varied. Furthermore, other embodiments of the invention are possible such, for example, as an embodiment wherein the locking member comprises only a segment of the skirt although the structure described above where the locking member is constituted by integral segments of both the to and the skirt is preferred.

As noted above, a recess may be utilized in lieu of the slot 42 formed in the neck of the container. Thus, a recess which does not extend completely through the thickness of the container neck and which opens onto the outer surface thereof may be utilized to obtain the benefits of the present invention. Moreover, the use of a recess enables the container, when closed with the closure member of the present invention, to hold a liquid without the possibility of leakage. It will thus be understood that the term "slot means" designates either a slot extending completely through the container neck or a recess which extends only partially therethrough.

Obviously numerous modifications and variations of the present invention are possible in the light of the above teachings. It is therefore to be understood that within the scope of the claims appended hereto, the invention may be practiced otherwise than as specifically disclosed herein.

What is claimed is:

1. In a unitary closure member formed of a deformable material and having a top and an integral peripheral skirt, said closure member being adapted to be threadedly fastened onto the neck of a container so that said top closes the open end of the container, the improvement comprising:

said closure member skirt has screw threads formed on the inwardly facing surface thereof adapted to threadedly cooperate with screw threads formed on the outer surfaces of the neck of a container to allow said closure member to be rotatably screwed onto the container neck, and a locking member integrally formed with said closure member and having a locking portion, said locking member being movable between a first position wherein said locking portion extends into an interior space defined by said skirt inwardly of said inwardly facing surface thereof and a second position wherein said locking portion is withdrawn from said interior space, said locking member being constituted at least in part by a segment of said peripheral skirt, and wherein said locking portion constitutes a protruding portion extending inwardly from said skirt segment, said peripheral skirt segment being at least partially separated from said skirt so as to be movable relative to said skirt between said first position wherein said protruding portion extends into said interior space and said second position wherein said protruding portion is withdrawn from said interior space, and wherein said locking member is further constituted by a segment of said closure top, said closure top segment being integral with and forming a continuation of said peripheral skirt segment and being at least partially separated from said top so as to be movable with respect thereto; and means formed integrally with said closure member for moving said locking member between said first and second positions.

2. The combination of claim 1 wherein said locking member constituted by said integral peripheral skirt and radial top segments is integrally connected to said closure member only at said top thereof.

3. The combination of claim 2 wherein said closure member top has a central dome-shaped portion defining an inwardly facing cam surface at its periphery adapted to abut the upper edge surface of the container neck when the closure member is threadedly fastened onto the neck of the container, and wherein said locking member is connected to said closure member proximate to at least a portion of said cam surface, whereby said dome-shaped portion constitutes said locking member moving means and said locking member is pivotally movable from said first to said second position by depressing said central dome-shaped portion of said top.

4. The combination of claim 1 wherein said locking member constituted by said integral peripheral skirt and radial top segments is integrally connected to said closure member only on said skirt thereof.

5. The combination of claim 4 wherein said closure top segment of said locking member and said closure top include cooperating means for restraining the movement of said closure top segment with respect to said top except in the radial direction, whereby said closure top segment constitutes said locking member moving means and said locking means is movable from said first to said second position by moving said closure top segment radially outwardly.

6. The combination of claim 5 wherein said cooperating means include side surfaces of said closure top segment and side surfaces of said top contiguous thereto, and wherein said respective contiguous side surfaces are dovetailed to restrain the movement of said closure top segment with respect to said top except in the radial direction.

7. The combination of claim 1 wherein said locking portion of said locking member is at least partially defined by side surfaces and wherein a detent portion is formed on at least one side surface of said locking portion which extends laterally from said side surface and adjacent to the inwardly facing surface of said skirt when said locking member is in said first position, said at least one detent portion thereby releasably holding said locking member in said first position.

8. The combination of claim 7 wherein said skirt has a pair of side surfaces extending outwardly from said inwardly facing surface contiguous with said locking member and wherein a recess is formed in at least one of said skirt side surfaces adapted to receive said lateral detent portion when said locking member is in said second position to releasably hold said locking member in said second position.

9. In a combination of a container and a unitary closure member therefore, said closure member being formed of a deformable material and having a top and an integral peripheral skirt, said closure member being adapted to be threadedly fastened onto the neck of the container so that said top closes the open end of the container, the improvement comprising:

said closure member skirt has screw threads formed on the inwardly facing surface thereof adapted to threadedly cooperate with screw threads formed on the outer surface of the neck of a container to allow said closure member to rotatably screw onto the container neck, and a locking member integrally formed with said closure member and having a locking portion, said locking member being movable between a first inner position and a second outer position;

means formed integrally with said closure member for moving said locking member between said first and second positions, said locking member moving means comprising a resilient dome-shaped portion of said closure member top, whereby when said dome-shaped portion is in its normal position, said locking member is in said first position and when said dome-shaped portion is deformed by urging the same downwardly, said locking member moves to said second position; and a container formed with a neck having screw threads provided on the outwardly facing surface thereof adapted to threadedly cooperate with screw threads formed on the inwardly facing surface of said closure member skirt, and surface means formed in said neck for engaging said locking portion of said closure member locking member when the closure member is threadedly fastened on the neck of the container and when the locking member is in said first position, and wherein said top closes the open end of the container, whereby said closure member is prevented from rotating on the container neck when said locking member is in said first position and said closure member is free to rotate on said container neck when said locking member is in said second position.

10. In a combination of a container and a unitary closure member, said closure member being formed of a deformable material and having a top and an integral peripheral skirt, said closure member being adapted to be threadedly fastened onto the neck of the container so that said top closes the open end of the container, the improvement comprising:

said neck of said container having screw threads provided on the outwardly facing surface thereof, and at least one locking means being formed on a segment of said container neck, said locking means including a locking surface portion;

said closure member skirt having screw threads formed on the inwardly facing surface thereof adapted to threadedly cooperate with said screw threads formed on the outer surface of said neck of said container, and wherein said closure member further includes (a) at least one locking member integrally connected with a peripheral region of said top of said closure member, said closure member including a downwardly depending segment contiguous with said skirt, said downwardly depending segment having an inwardly extending locking portion; and (b) means formed integrally with said closure member for moving said locking member between a first position wherein said locking portion of said locking member is in engaging relationship with said locking surface portion of said locking means formed on said container neck when said closure member has been screwed onto said neck to close said container and a second position wherein said locking portion is removed from said engaging relationship, said moving means comprising a resilient dome-shaped portion of said top or said closure member, whereby when said dome-shaped portion is in its normal position, said locking member is in said first position and when said dome-shaped portion is deformed by urging the same downwardly, said peripheral region of said closure member top is deformed to move said locking member to said second position.

11. In a unitary closure member formed of a deformable material and having a top and an integral skirt, said closure member including screw threads formed on the inwardly facing surface of said skirt and adapted to threadedly cooperate with screw threads formed on the outer surface of the neck of a container, said closure member thereby being adapted to be threadedly fastened to the container neck so that said top closes the open end of the container, the improvement comprising:

at least one locking member extending from a peripheral region of said top of said closure member, said closure member including a downwardly depending segment contiguous with said skirt, said downwardly depending segment including a locking portion; and means formed integrally with said closure member for moving said locking member between a first inner position wherein said locking portion of said locking member is adapted to engage a locking surface portion formed on the container neck when said closure member has been screwed onto the neck to close said container and a second outer position wherein said locking portion is in nonengaging relationship with the container locking surface portion, said moving means comprising a resilient dome-shaped portion of said top of said closure member, whereby when said dome-shaped portion is in its normal position, said locking member is in said first position and when said dome-shaped portion is deformed by urging the same downwardly said peripheral region of said closure member top is deformed to move said locking member to said second position.

12. A unitary closure member formed of deformable material adapted to be threadedly fastened onto the neck of a container, said closure member including a top and an integral portion adapted to skirt the exterior of the container neck, comprising:

a locking member formed integrally with said closure member, said locking member including a segment contiguous with said skirting portion which is movable between a first locking position and a second non-locking position, said second non-locking position being spaced outwardly of said first locking position; and means for moving said locking member segment between said first and second positions, said moving means including a resilient deformable portion of said closure member top;

whereby when said deformable portion is in its normal configuration, said locking member segment is in said first position and when said deformable portion is deformed, said locking member segment is moved to said second position.

13. The combination of claim 12 wherein said deformable portion is constituted by a substantially dome-shaped portion of said closure member top.

* * * * *